US005082099A

United States Patent [19]

Abe

[11] Patent Number: 5,082,099

[45] Date of Patent: Jan. 21, 1992

[54] APPARATUS FOR ACCEPTING TWO KINDS OF COINS

[75] Inventor: Hiroshi Abe, Tokyo, Japan

[73] Assignee: Asahi Seiko Kabushiki Kaisha, Tokyo, Japan

[21] Appl. No.: 511,461

[22] Filed: Apr. 20, 1990

[30] Foreign Application Priority Data

Apr. 25, 1989 [JP] Japan ..... 1-103378

[51] Int. Cl.[5] ..... G07D 5/02

[52] U.S. Cl. ..... 194/338; 194/345; 453/3

[58] Field of Search ..... 194/334, 338, 351, 345; 453/3, 5, 9

[56] References Cited

U.S. PATENT DOCUMENTS

| | | | |
|---|---|---|---|
| 1,316,887 | 9/1919 | Grover | 194/334 X |
| 4,570,779 | 2/1986 | Abe | 194/334 X |
| 4,878,573 | 11/1989 | Kobayashi et al. | 194/338 |

FOREIGN PATENT DOCUMENTS

| | | | |
|---|---|---|---|
| 0020797 | 2/1979 | Japan | 194/345 |
| 57-46110 | 10/1982 | Japan . | |
| 62-129669 | 8/1987 | Japan . | |
| 453774 | 6/1968 | Switzerland | 194/338 |
| 0317162 | 8/1929 | United Kingdom | 194/338 |
| 8808174 | 10/1988 | World Int. Prop. O. | 453/9 |

*Primary Examiner*—David A. Bucci
*Assistant Examiner*—William M. Hienz
*Attorney, Agent, or Firm*—Nilles & Nilles

[57] ABSTRACT

An apparatus for accepting two kinds of coins comprises a coin diameter discriminating passage unit having a coin passage adapted for discriminating diameters of coins and being openable downwards for dropping an unacceptable coin from the coin passage, a vertically extending coin returning chute arranged below the coin diameter discriminating passage unit for receiving the unacceptable coin dropped therefrom and two coin material discriminating units arranged at both sides of the coin returning chute, respectively. The coin diameter discriminating passage unit has two opposed side outlets adapted for introducing acceptable coins into the respective coin material discriminating units. Thus, the apparatus has a reduced width and thickness and a high flexibility owing to possibility of exchanging the coin diameter discriminating passage unit and/or the coin material discriminating unit for various kinds of coins.

7 Claims, 10 Drawing Sheets

APPARATUS FOR ACCEPTING TWO KINDS OF COINS

BACKGROUND OF THE INVENTION

1. Field of the Invention

The present invention relates to an apparatus for accepting two kinds of coins, in particular to such an apparatus suitable for use in public telephones.

2. Related Prior Art

Hitherto, there has been known apparatus adapted to accept two kinds of coins such as 10 yen coin and 100 yen coin for use in public telephones as disclosed in Japanese Patent Application Publication No. 57-46110.

Generally, such a coin accepting apparatus for public telephones differs from usual coin accepting apparatus for automatic vending machines or the like in that it is required to have not only functions of discriminating diameter and material of coins but also functions of accumulating a plurality of coins, accepting one coin from the accumulated coins in each response to an accepting signal and returning the accumulated coins. In order to design such an apparatus for accepting two kinds of coins that is simple and small in size, the Japanese Patent Application Publication proposes to arrange two coin inserting slots for 10 yen coin and 100 yen coin in a front plate in such a manner that the coin inserting slots are aligned in a line. However, such arranged apparatus is still complicate and large in size.

SUMMARY OF THE INVENTION

An object of the present invention is to provide an apparatus for accepting two kinds of coins for use in public telephones, which is simpler in design and smaller in size than the prior art.

According to the present invention, the apparatus for accepting two kinds of coins comprises a coin diameter discriminating passage unit having a coin passage adapted for discriminating a diameter of a coin inserted into a coin inlet and that is openable downwards for dropping an unacceptable coin from the coin passage, a vertically extending coin returning chute arranged below the coin diameter discriminating passage unit for receiving the unacceptable coin dropped therefrom and two coin material discriminating units arranged at opposite sides of the coin returning chute, respectively, for receiving acceptable coins from opposed side outlets that open into opposite sides of the coin diameter discriminating passage unit. The coin diameter discriminating passage unit has a coin passage defined by two parallelly spaced fixed and movable side plates, an inclined coin guide rail and two opposed side outlets formed in the side plates at the outlet end of the passage unit for dropping smaller and larger acceptable coins from the opposed side outlets, respectively, after passing through the coin passage. The coin diameter discriminating unit includes upper and lower coin diameter checking guide surfaces extending along the coin passage for guiding the upper edges of the larger and smaller acceptable coins rolled on the guide rail. The movable side plate is usually held in an open position by means of a spring and is closed by an electromagnet which may be energized when a receiver of the telephone is taken off to switch on an associated receiver hook switch.

Each coin material discriminating unit has an upper inlet connected to the side oulet of the coin diameter discriminating passage unit, a lower outlet, a sensor which can output a signal to a microcomputer in a known manner when the material of a coin passing the sensor from the upper inlet thereof is acceptable, and a coin accumulating passage arranged for accumulating a plurality of coins and for accepting one coin positioned at an outlet of the coin accumulating passage at each time when an acceptance signal is generated in a known manner.

The fixed and movable side plates in the coin diameter discriminating passage unit are inclined toward the side of the movable side plate at an angle to the vertical. The movable side plate has an opening which is provided with a coin diameter checking plate at the outer side of the side plate. The checking plate extends parallel to the coin guide rail and has upper and lower coin guide surfaces. The upper guide surface is substantially coplanar with the inner surface of the movable side plate and the lower guide surface is withdrawn toward the outside of the upper guide surface. At the outlet end of the passage unit, an outlet rail is provided in alignment with the coin guide rail. The outlet rail has a larger acceptable coin guiding surface which is inclined toward the movable side plate to provide a large side outlet of a dimension sufficient to permit passage of the larger acceptable coin therethrough and a smaller acceptable coin guiding surface which is inclined toward the fixed side plate to provide a small side outlet of a dimension sufficient to permit passage of only the smaller acceptable coin therethrough.

According to the present invention, both kinds of coins such as 100 yen and 10 yen coins can be inserted into the coin accepting apparatus from a common coin inserting slot. When an unacceptably small coin having a diameter smaller than that of 100 yen coin which has a diameter smaller than that of 10 yen coin is inserted, the diameter of the small coin is discriminated by the coin diameter checking plate arranged in the coin diameter discriminating passage to drop the unacceptable small coin from the passage to the returning chute to thereby return to a returning opening. The inserted 100 yen and 10 yen coins that can pass through the coin diameter discriminating passage are introduced into respective coin material discriminating units from side openings formed in the side plates at the end of the coin diameter discriminating passage, respectively. 100 yen and 10 yen coins are discriminated in the respective coin material discriminating units, respectively, and then acceptable coins are accumulated in the coin accumulating passages. When the coin accumulating passage is open at the lower end in response to an acceptance signal in the known manner, a coin is accepted from the lower end. If desired, all the accumlated coins can be returned to the returning opening.

As mentioned above, according to the present invention, the coin diameter discriminating passage unit opens downwardly for dropping unacceptable coins from the coin diameter discriminating passage and is provided with two opposed side outlets for acceptable smaller and larger coins at the rear end of the passage unit. Accordingly, two coin material discriminating units having respective coin accumulating passages can be arranged at both sides of the coin returning chute arranged just under the coin discriminating passage for receiving an unacceptable coin dropped therefrom and hence the width and thickness of the apparatus can be substantially reduced.

Moreover, the coin diameter discriminating passage unit, the coin returning chute, the coin material discriminating units having the coin accumulating passage and the front plate having a coin inserting slot and a coin returning opening can be separately produced and then integrally assembled, and hence the apparatus can be easily manufactured with low cost. Furthermore, the apparatus for various kinds of coins can easily provide only by exchanging the coin diameter discriminating unit and/or coin material discriminating unit with simple adjustment.

The coin diameter discriminating passage unit may include two parallelly spaced fixed and movable side plates inclined at an angle to the vertical that are arranged to usually open downwardly by holding the movable side plate in the open position by means of a spring and which are closed by the electromagnet which is energized when the receiver of the telephone is taken off to switch on the receiver hook switch. With such an arrangement, if a coin is inserted from the coin inserting slot into the apparatus before the receiver is taken off, the inserted coin is immediately returned and if a coin is retained in the coin diameter discriminating passage, the retained coin can be returned when the receiver is hooked to open the passage.

The objects, features and advantages of the present invention will be better understood from the following description with reference to the accompanying drawings.

DESCRIPTION OF THE PREFERRED EMBODIMENT

Figure 1:
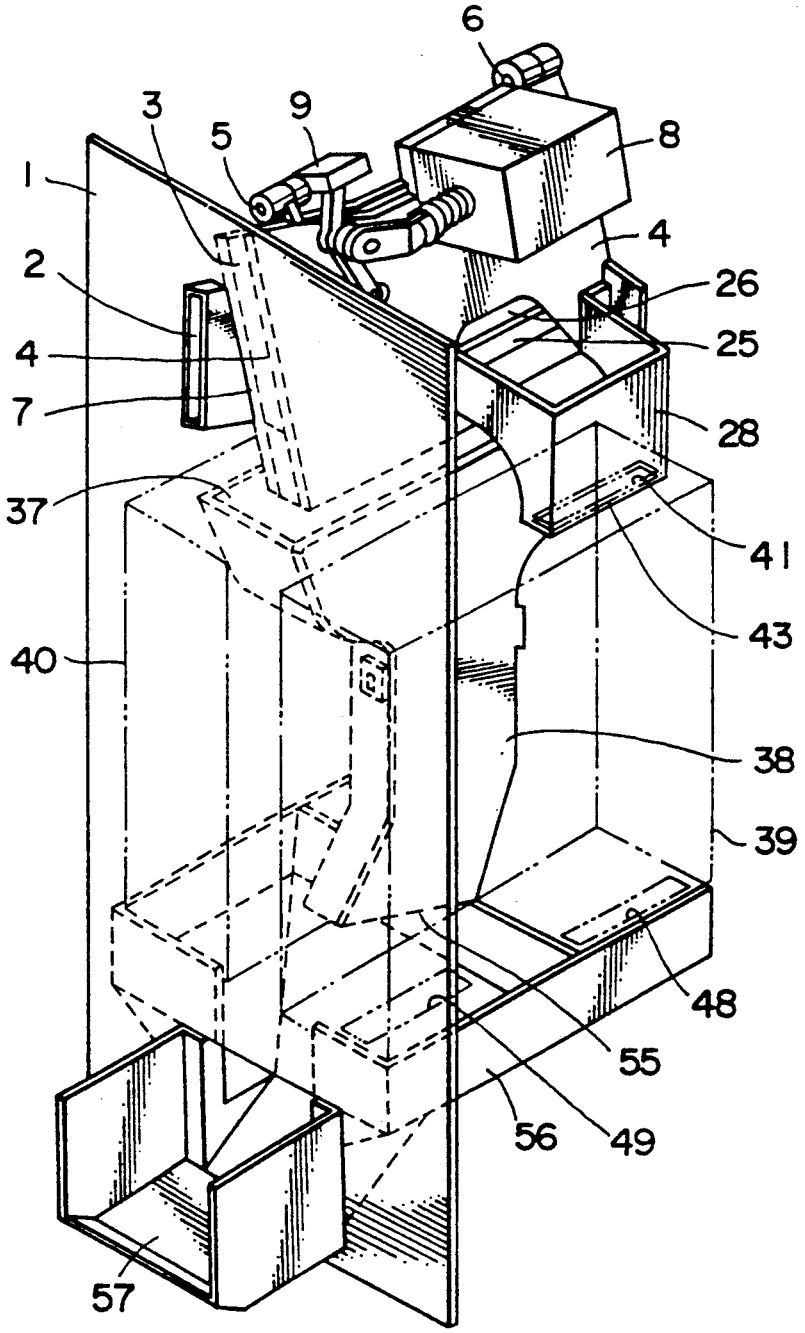
FIG. 1 is a schematic perspective view of an embodiment of the coin accepting apparatus according to the present invention.
Figure 2:
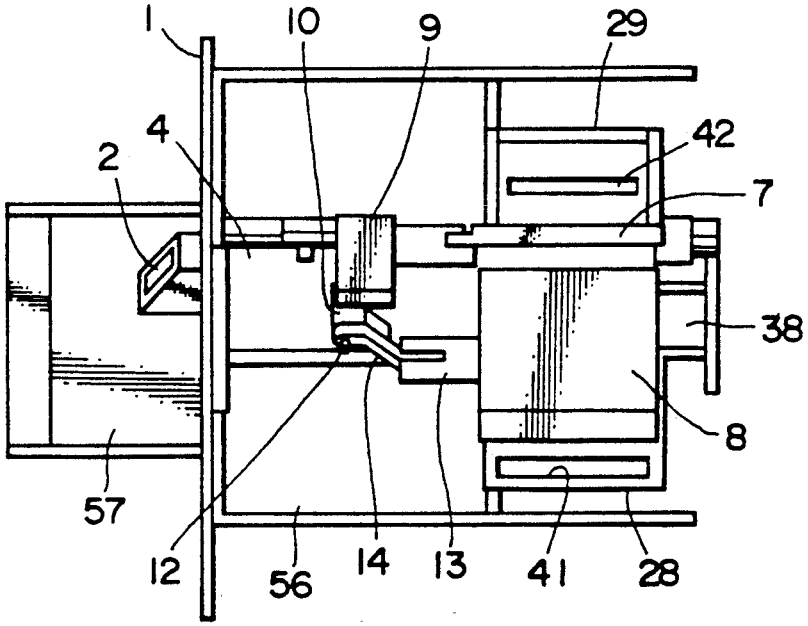
FIG. 2 is a plan view of the apparatus shown in FIG. 1.
Figure 3:
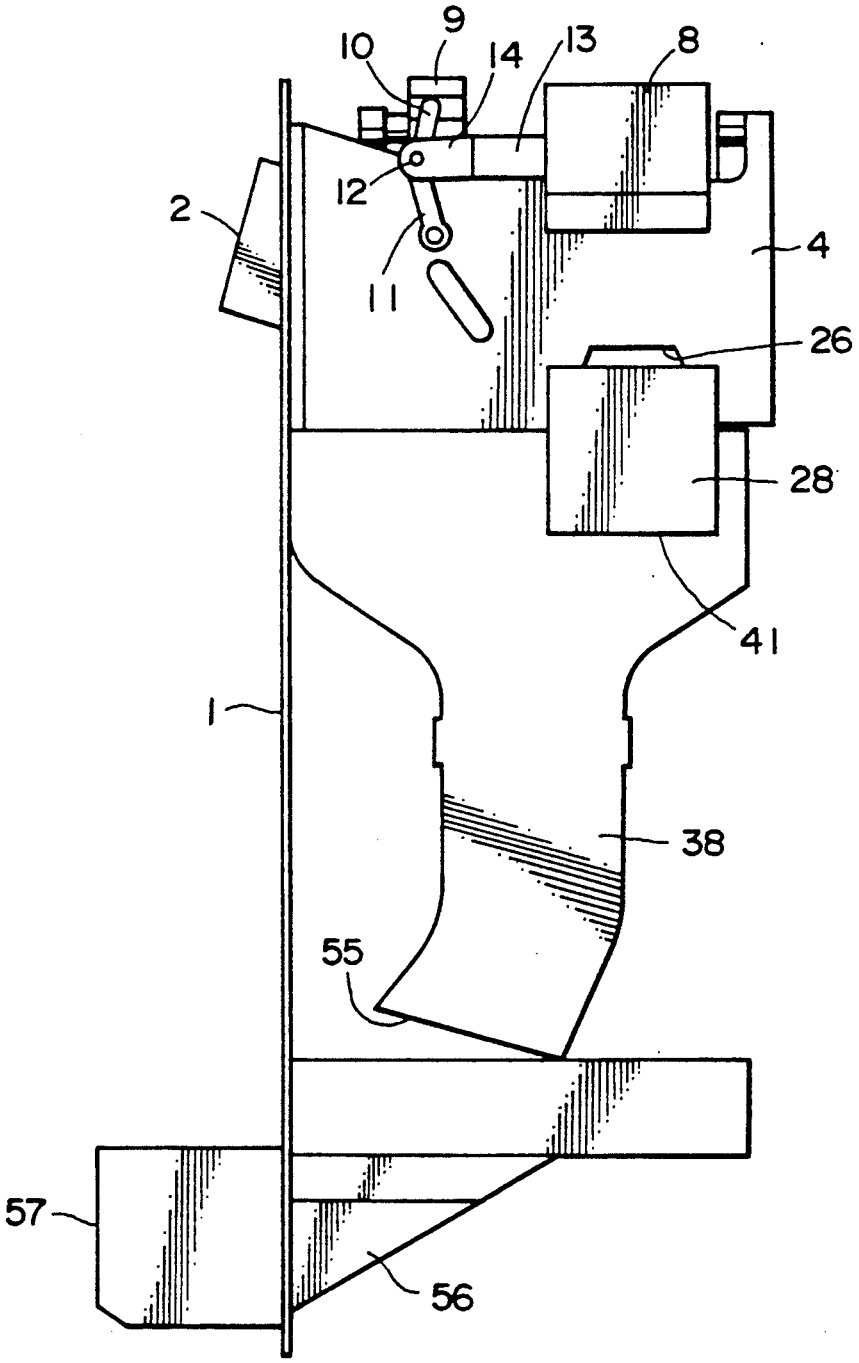
FIG. 3 is a right side elevational view of the apparatus shown in FIG. 1.
Figure 4:
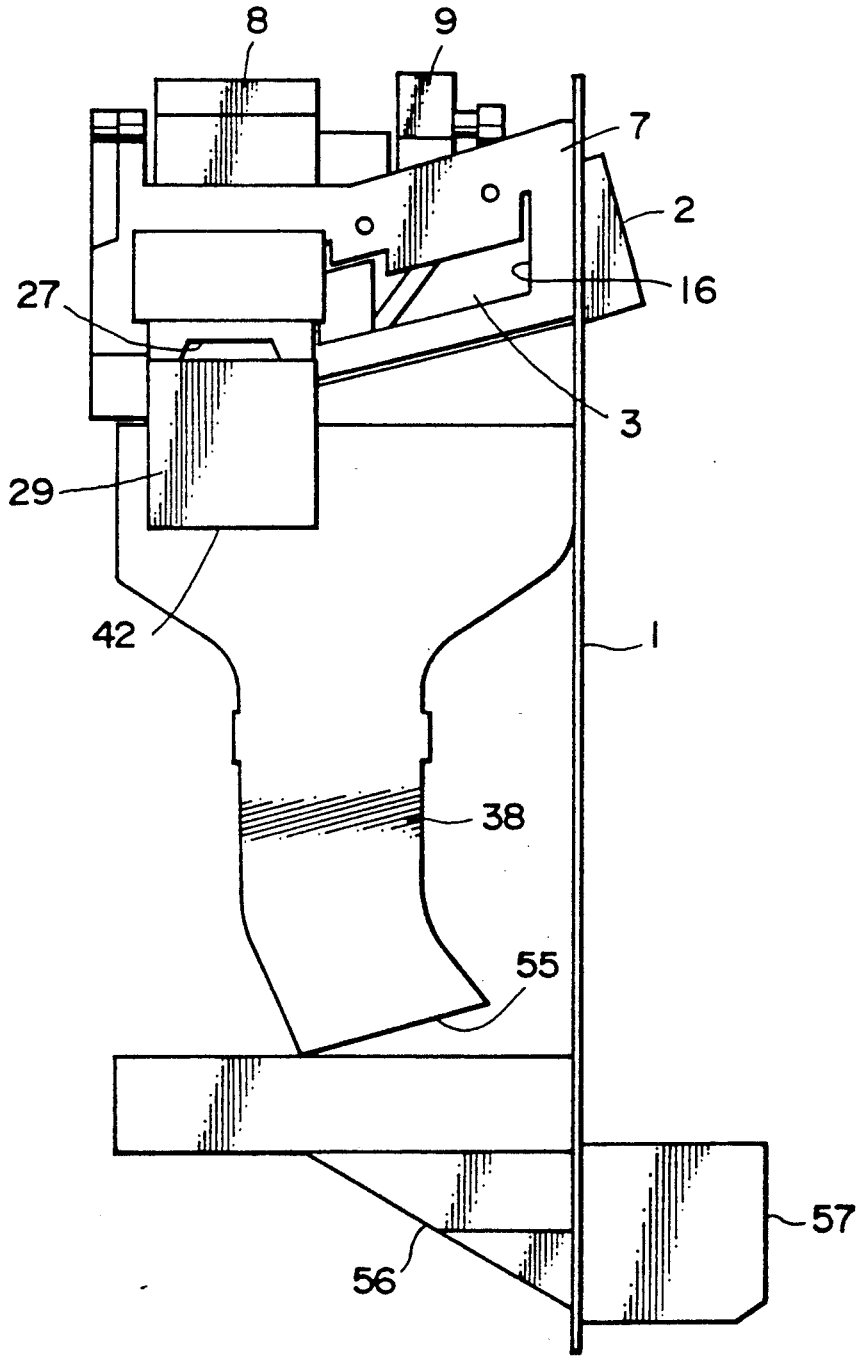
FIG. 4 is a left side elevational view of the apparatus shown in FIG. 1.
Figure 5:
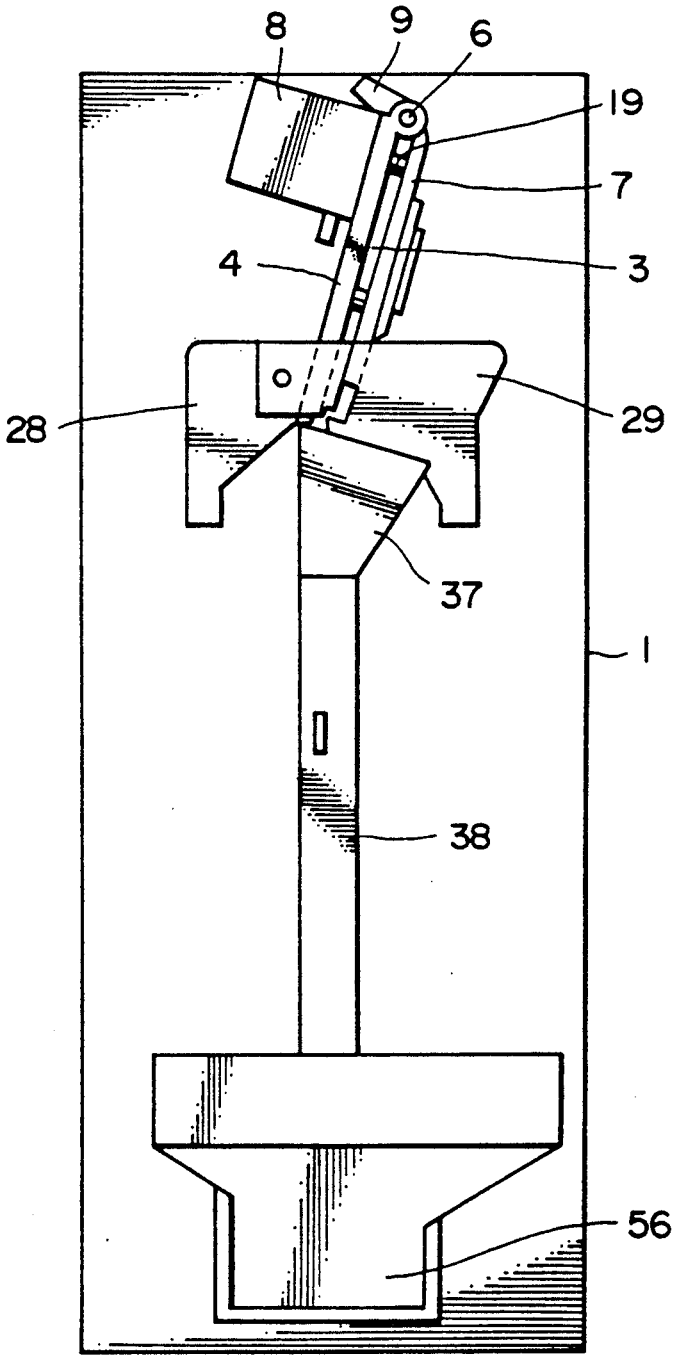
FIG. 5 is a back view of the apparatus shown in FIG. 1.
Figure 6:
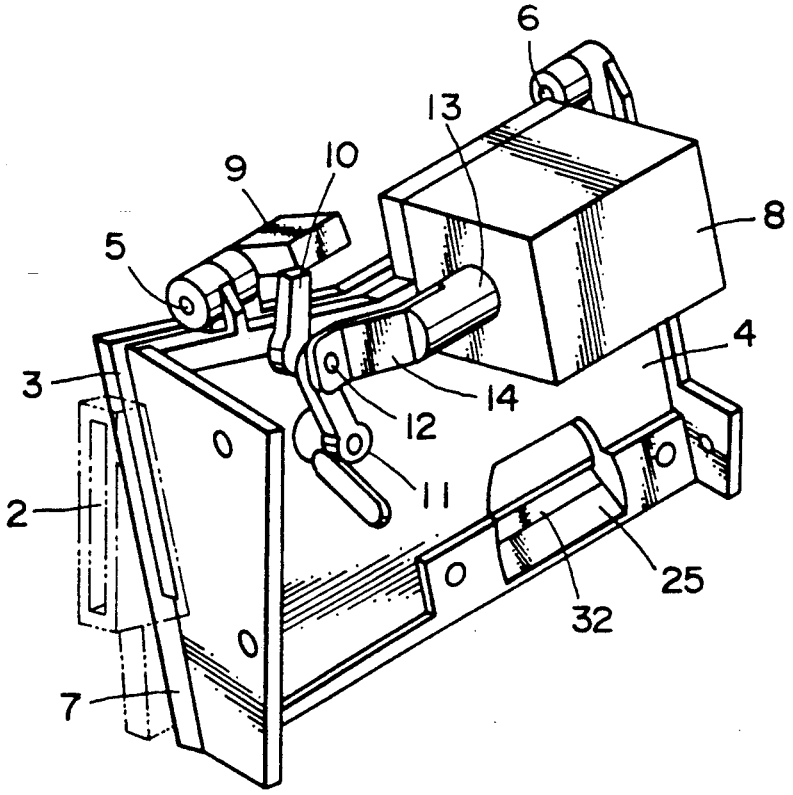
FIG. 6 is a perspective view of the coin diameter discriminating passage unit.

The drawings illustrate an embodiment of the present invention. In the embodiment, a front plate 1 is provided with a coin inserting slot 2 at an upper portion thereof. The slot 2 has a dimension which does not permit insertion of a coin having a diameter larger than that of 10 yen coin. A coin diameter discriminating unit having a coin passage 3 is arranged at the rear side of the front plate 1 so as to receive a coin inserted from the coin inserting slot 2. The coin passage 3 is defined by a fixed side plate 4 which is fixed to the front plate 1 at an angle to the vertical and a movable plate 7 which is hinged to the fixed side plate 4 by hinge pins 5 and 6 at the upper end thereof so as to be openable downwardly. The movable side plate 7 is usually held in an open position as shown by a chain line in FIG. 6 by means of a spring (not shown) interposed between the fixed side plate 4 and the movable side plate 7. The movable side plate 7 is held in a closed position shown in FIG. 6 by an electromagnet 8 which is energized through a switch which is switched on by means of a push button or a hook switch which is switched on when a receiver of the telephone is taken off. The electromagnet 8 is fixed to the fixed side plate 4 as shown in FIG. 6. The fixed side plate 4 and a universal connecting plate 9 fixed to the movable side plate 7 are connected by means of links 10 and 11 which are connected by a connecting pin 12 which is connected through a connecting plate 14 to a plunger 13 of the electromagnet 8.

The fixed and movable side plates 4 and 7 are inclined toward the side of the movable plate at an angle to the vertical. The movable side plate 7 is provided with a guide rail 15 which is inclined downwardly from an inlet end to an outlet end of the coin passage 3 and has an opening 16 which extends parallel with the coin guide rail. A coin diameter checking plate 18 is adjustably secured to the outer side of the movable side plate 7 by means of screws 19 and vertical slots and is extended in parallel with the coin guide rail so as to adjustably limit an upper edge 17 of the opening 16. The coin diameter checking plate 18 has upper and lower guide surfaces 20 and 21 for guiding the upper edges of the larger coin such as 10 yen coin and the smaller coin such as 100 yen coin when rolling on the coin guide rail 15. The upper guide surface 20 is substantially coplanar with the inner surface of the movable side plate 7 and is provided by a rail 22 protruded through the opening 16 from the plate 18. The lower guide surface 21 is provided by the inner surface of the coin diameter checking plate 18. The coin guide rail 15 is provided with an inner groove 23 at the outlet end thereof and the movable side plate 7 is provided with an outlet guide surface 24 for guiding 100 yen coin engaging with the lower guiding surface 21 into the groove 23. Thus, the outlet guide surface 24 is extended from the lower guide surface 21 to the upper guide surface, i.e. the inner surface of the movable side plate 7 at an angle to the axial direction of the coin passage 3.

An outlet rail 25 is provided as an extension of the coin guide rail 15 at the end of the coin passage 3 and is aligned with the coin guide rail 15. The fixed side plate 4 and the movable side plate 7 are provided at the opposite sides of the outlet rail 25 with opposed side outlets 26 and 27 for smaller and larger acceptable coins. These side outlets 26 and 27 are provided with side guide chutes 28 and 29 for dropping coins from the side outlets into the coin material discriminating units 39 and 40, respectively.

The outlet rail 25 has an inclined guide rail surface 30 of the side outlet 27, which surface is inclined toward the side of the movable side plate 7 for guiding the larger acceptable coin to the side outlet 27, a horizontal guide rail surface 31 for guiding the smaller acceptable coin along the fixed side plate 4, and an inclined guide rail surface 32 of the side outlet 26 which surface is inclined toward the side of the fixed side plate 4 for guiding the smaller acceptable coin to the side outlet 26. The lengths of the guide rail surfaces 30 and 32 are limited by stops 33 and 34 formed at the end of the outlet rail 25. The guide rail surface 32 of the side outlet 26 has a length corresponding to the diameter of the smaller coin.

Figure 7:
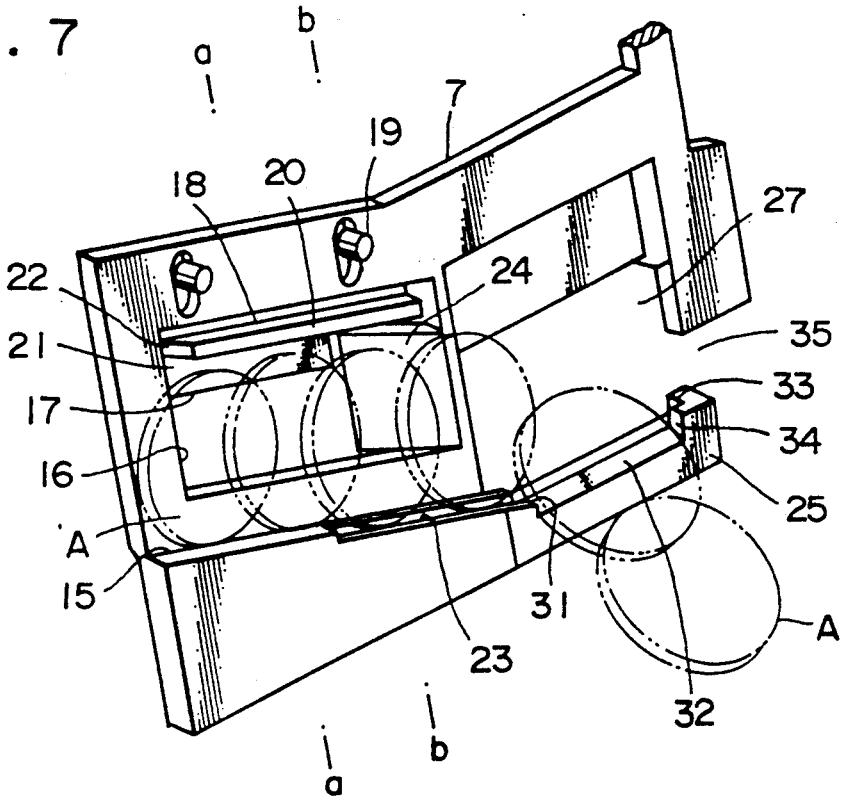
FIG. 7 is a perspective view illustrating a smaller coin passing through the coin diameter discriminating passage.

With the above arrangement, the smaller acceptable coin, i.e. 100 yen coin "A" is guided by engaging its upper portion with the lower guide surface 21 of the coin diameter checking plate 18 to pass through the coin passage 3 by rolling on the guide rail 15 as shown in FIG. 7. The smaller acceptable coin is then guided by the outlet guide surface 24 to enter in the groove 23 formed in the guide rail at the side of the fixed side plate and subsequently guided by the horizontal guide rail surface 31 and by the inclined guide rail surface 32 on the outlet rail 25. Thus, the smaller coin is hit with the stop 34 and then slides down through the inclined guide surface 32 of the side outlet 26 into the side guide chute 28 at the outside of the fixed side plate 4.

Figure 8:
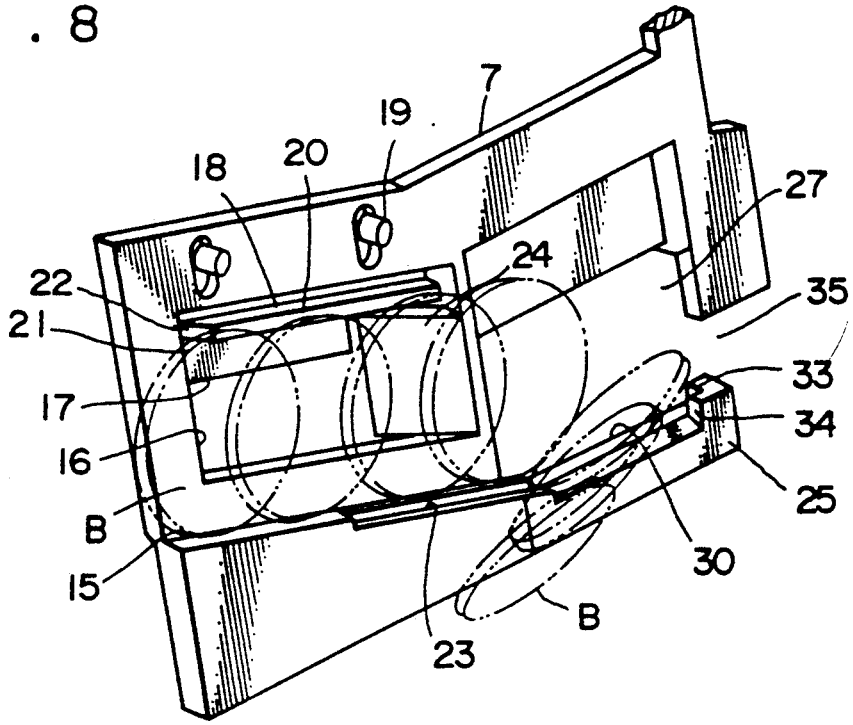
FIG. 8 is a perspective view illustrating a larger coin passing through the coin diameter discriminating passage.
Figure 9:
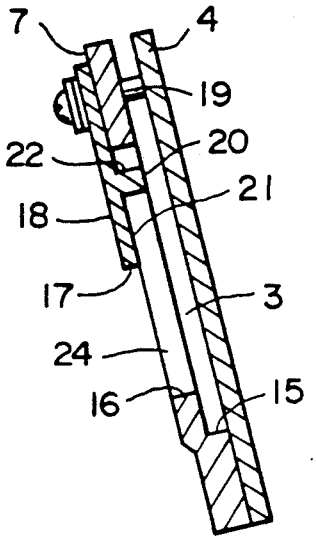
FIG. 9 is a sectional view taken along a line a—a in FIG. 7.
Figure 10:
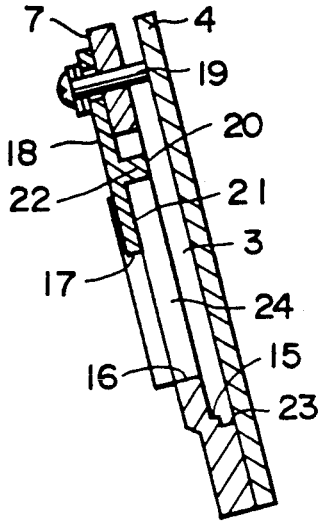
FIG. 10 is a sectional view taken along a line b—b in FIG. 7.
Figure 11:
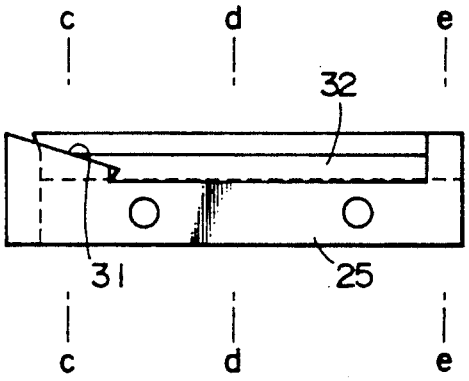
FIG. 11 is a side view of an outlet rail shown in FIG. 7.
Figure 12:
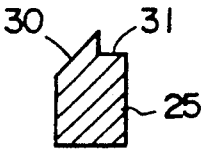
FIG. 12 is a sectional view taken along a line c—c in FIG. 11.
Figure 13:
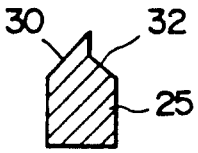
FIG. 13 is a sectional view taken along a line d—d in FIG. 11.
Figure 14:
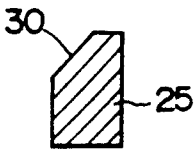
FIG. 14 is a sectional view taken along a line e—e in FIG. 12.
Figure 15:
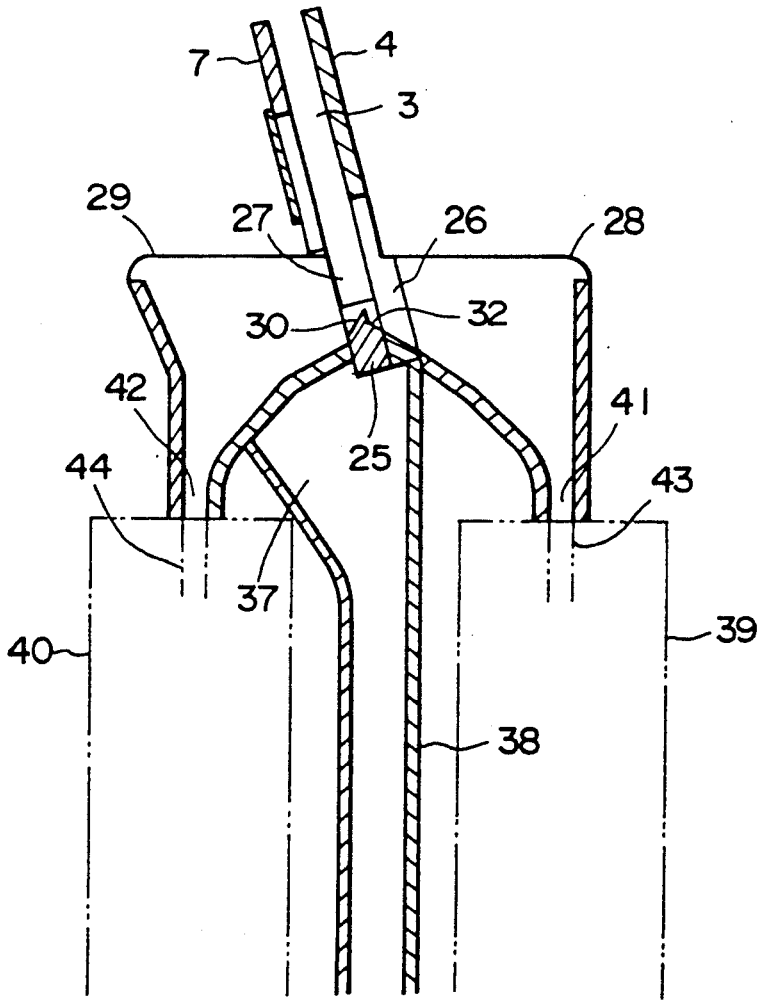
FIG. 15 is a sectional view of a portion of the apparatus at the outlet of the coin diameter discriminating passage.

While, the larger acceptable coin, i.e. 10 yen coin "B" is guided by engaging its upper portion with the upper guide surface 20 of the coin diameter checking plate 18 to pass through the coin passage 3 by rolling on the guide rail 15 as shown in FIG. 8. The larger acceptable coin is then guided by the inclined guide rail surface 30 and finally hit with the stop 33 to slide down on the inclined guide rail surface 30 of the side outlet 27 into the side guide chute 29 at the outside of the movable side plate 7.

Under the coin diameter discriminating passage 3 is provided a coin returning chute 38 having an enlarged open top 37 for receiving the unacceptable coin dropped from the coin passage 3. The coin returning chute 38 is vertically extended downwardly and has an outlet 55 at the lower end, which outlet is open to a returned coin receiving plate 56 connected to the coin returning outlet 57 on the front plate 1.

Coin material discriminating units 39 and 40 for discriminating material of 100 yen coin and 10 yen coin are arranged at the opposite sides of the coin returning chute 38 so as to receive coin dropped through the side guide chute 28, 29 into upper inlets 43 and 44 of the unit 40, respectively.

Figure 16:
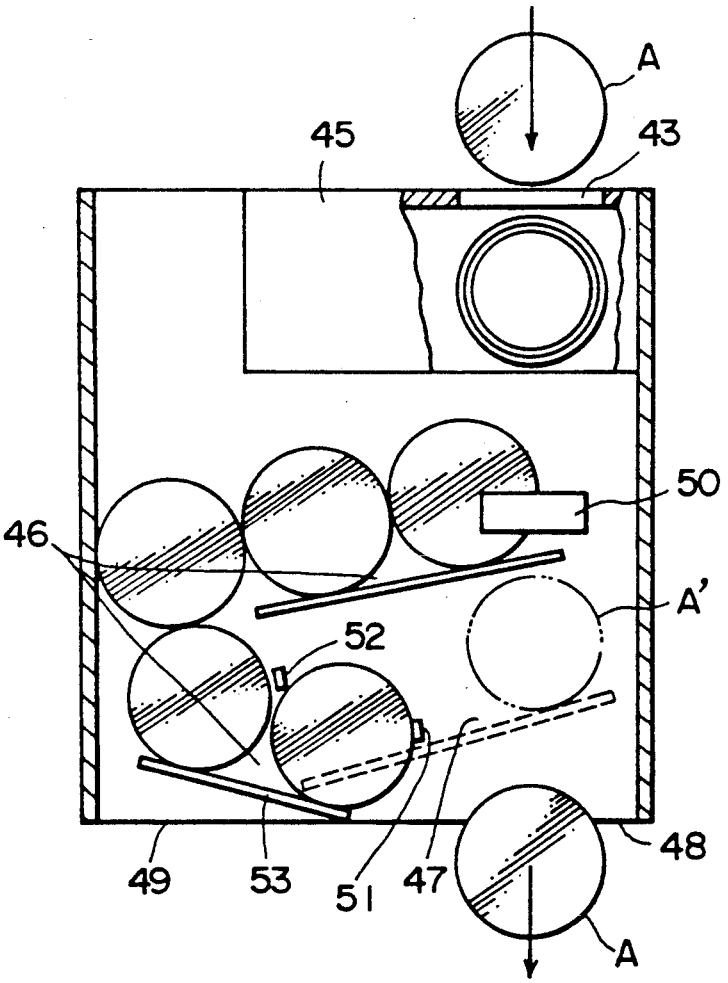
FIG. 16 is a schematic view illustrating the inner construction of the coin material discriminating unit shown in FIG. 1.

A coin material discriminating apparatus as disclosed in Japanese Utility Model Application Laid-Open Publication No. 62-129669 can be properly used as the coin material discriminating units 39 and 40 for discriminating the material of coins and accumulating a plurality of acceptable coins. The coin material discriminating unit, as shown in FIG. 16, includes a top inlet 43, a material sensor 45, an acceptable coin accumulating passage 46, a unacceptable coin returning passage 47, and bottom outlets 48 and 49 for the acceptable coin and unacceptable coin. The acceptable coin A passes through the sensor 45 from the top inlet 43 to enter the acceptable coin accumulating passage 46, while the unacceptable coin A' passes through the sensor 45 to enter the returning passage 47 through a gate 50 to thereby pass through the bottom outlet 49. Each of coins accumulated in the passage 46 is accepted through the bottom outlet 48 at each time when electromagnetic solenoids (not shown) are energized by a accepting signal to operate the first and second stops 51 and 52 in a known manner. The coin accumulating passage 46 includes an openable bottom plate 53 which is opened mechanically or electromagnetically by means of a push button or a hook switch which is operated by the receiver of the telephone to return coins remained in the accumulating passage 46 to the coin returning opening 57 through the bottom outlet 49.

What is claimed is:

1. An apparatus for receiving larger and smaller diameter coins and discriminating them to identify unacceptable coins, larger diameter acceptable coins, and smaller diameter acceptable coins, comprising:

a front plate having upper and lower portions, a coin inlet in said upper portion and a coin returning outlet opening in said lower portion;

a coin diameter discriminating passage unit, a portion of which is adapted for discriminating diameters of coins inserted into said coin inlet and which is operable to form a downward opening for dropping an unacceptable larger or smaller diameter coin from said portion, said unit including an outlet end with two opposed side outlets for discharging acceptable diameter coins, and a vertically extending coin returning chute arranged below the coin diameter discriminating passage unit for receiving the unacceptable diameter coin dropped therefrom and for delivering the unacceptable coin to the coin returning outlet;

two coin material discriminating units arranged at opposite sides of the coin returning chute, respectively, one of the two opposed side outlets introducing the larger acceptable coins received from said coin diameter discriminating passage unit into one of the coin material discriminating units and the other of the two opposed side outlets introducing the smaller acceptable coin into the other of said coin material discriminating units; and said front plate, coin diameter discriminating passage unit, coin returning chute and two coin material discriminating units being integrally connected.

2. The apparatus claimed in claim 1, wherein the coin diameter discriminating passage unit portion includes two parallel spaced side plates one of which is fixed and the other is movable and an inclined coin guide rail positioned between the side plates.

3. The apparatus claimed in claim 2, wherein the movable side plate is held in a normally open position by means of a spring and is movable to a closed position by a selectably energizable electromagnet.

4. The apparatus claimed in claim 2, wherein said movable side plate has an inner guide surface, an opening, and a coin diameter checking plate which extends parallel to the coin guide rail, the fixed and movable side plates being inclined at an angle to the vertical so as to cause a passing coin to lean against the inner guide surface of the movable side plate, the checking plate having upper and lower coin guide surfaces for guiding the upper edges of the respective larger and smaller acceptable coins rolling on the guide rail, the upper guide surface being substantially coplanar with the inner guide surface of the movable side plate, and the lower guide surface being spaced from the upper guide surface.

5. The apparatus claimed in claim 2, wherein the two opposed side outlets include a larger side outlet in the movable side plate and a smaller side outlet in the fixed side plate, and the coin diameter discriminating passage unit includes an outlet rail aligned with the coin guide rail at the outlet end of the passage unit, the outlet rail having a larger acceptable coin guiding surface which is inclined so as to guide the larger acceptable coin toward the larger side outlet of said two opposed side outlets, the larger side outlet having a dimension sufficient to permit the larger acceptable coin to pass therethrough, and the outlet rail also having a smaller acceptable coin guiding surface which is inclined so as to guide the smaller acceptable coin toward the smaller side outlet of said two opposed side outlets, the smaller side outlet having a dimension, sufficient to permit only the smaller acceptable coin to pass therethrough.

6. The apparatus claimed in claim 1, wherein each of the coin material discriminating units has: an inlet and an outlet at the respective upper and the lower ends thereof; a sensor for discriminating material of a coin; and a coin accumulating passage arranged for accumulating a plurality of coins; one of said coin material discriminating unit inlets being connected to one of the side outlets of the coin diameter discriminating passage unit.

7. An apparatus for receiving larger and smaller diameter coins and discriminating them to identify unacceptable coins, larger diameter acceptable coins, and smaller diameter acceptable coins, comprising:

a frame means having a coin inlet and a coin return outlet spaced below said inlet;

a coin diameter discriminating unit mounted on said frame means, a portion of said unit being adapted for receiving coins from said inlet and discriminating their diameters, said portion being operable to form an unacceptable coin outlet, said unit comprising a central coin returning chute having opposite sides and mounted to receive and return said unacceptable coins to said coin returning outlet, and further comprising two spaced apart opposed side outlets, one of said side outlets discharging said larger acceptable diameter coins to one side of said central coin returning chute and the other of said side outlets discharging smaller acceptable diameter coins to the other side of said central coin returning chute; and two coin material discriminating units mounted on said frame means, one on each side of said coin returning chute, to receive said discharged acceptable large and small diameter coins, respectively.

* * * * *